US005353883A

United States Patent [19]

Kattentidt et al.

[11] Patent Number: 5,353,883

[45] Date of Patent: Oct. 11, 1994

[54] DRILLING TOOL OF THE DISPLACING TYPE

[75] Inventors: Hinrich Kattentidt, Darmstadt-Eberstadt; Magnus Mauch, Göppingen, both of Fed. Rep. of Germany

[73] Assignee: DELMAT Maschinenfabrik Reihnold Dornfeld GmbH, Esslingen, Fed. Rep. of Germany

[21] Appl. No.: 83,334

[22] Filed: Jun. 28, 1993

[30] Foreign Application Priority Data

Jun. 26, 1992 [DE] Fed. Rep. of Germany ..... 4220976

[51] Int. Cl.[5] ..... E21B 7/00

[52] U.S. Cl. ..... 175/19; 175/21

[58] Field of Search ..... 175/19–21, 175/394

[56] References Cited

U.S. PATENT DOCUMENTS 4,458,765 7/1984 Feklin et al. ..... 175/21 X 5,031,707 7/1991 Gerasimenko et al. ..... 175/19

FOREIGN PATENT DOCUMENTS 0034106 8/1981 European Pat. Off. .

2132667 7/1984 United Kingdom .

*Primary Examiner*—Michael Powell Buiz

*Attorney, Agent, or Firm*—Fred Philpitt

[57] ABSTRACT

A drilling tool (10) of the displacing type comprises a displacing head (22) including a cylindrical mid head portion (24) and lower and upper frustoconical head portions (26, 28). A lower drill portion (12) carries a helical rib (16) which also extends over the lower head portion (26), all portions of this rib being of equal height. The upper head portion (28) is formed with spiroconical displacing walls (32).

4 Claims, 4 Drawing Sheets

DRILLING TOOL OF THE DISPLACING TYPE

The invention relates to a drilling tool of the displacing type.

BACKGROUND

Such a drilling tool is disclosed in the GB 2 132 667 A1 document. This drilling tool has a displacing head formed with smooth exactlie frustoconical lower and upper portions. Due to the large surface contact between the displacing head and the soil large forces are required to rotate and advance the drilling tool.

The object of the present invention is to improve a drilling tool of the displacement type so such that the drive unit acting on the drilling tool needs to provide smaller forces in at least one of the two feed directions (circumferential direction, axial direction).

THE INVENTION GENERALLY

In a drilling tool in accordance with our invention a helical rib is provided in the lower portion of the displacing head, too, which will provide an axial feed force upon rotation of the drilling tool. Thus only a correspondingly smaller fraction of the overall axial feed force must be provided by the drive unit acting on the drilling tool. Since the soil becomes increasingly compacted in the region of the lower portion of the displacing head, those portions of the helical rib, which are of reduced effective height only, since they are arranged above the lower portion of the displacing head, are still able to produce an appreciable axial force.

In a drilling tool in accordance with one embodiment of the invention the area of contact between the lower portion of the displacing head and the soil is reduced so that only a smaller frictional force must be overcome. Due to the conical and spiral geometry of the active surface of the displacing ribs very effective radial displacement of the soil obtained.

In a drilling tool in accordance with another embodiment the friction forces between the lower portion of the displacing head and the soil are also reduced, since the actual displacement work is predominantly effected through the rotatable displacing rollers which roll on the soil instead slipping thereon.

The improvement in accordance with another embodiment is advantageous in view of providing an optimum axial feed force. In addition, with comparatively soft soils the drilling tool can be withdrawn from the hole produced quickly without adjusting the axial withdrawal velocity to the speed of rotation, since the helical rib does not project over the cylindrical mid-portion of the displacing head.

The further improvement of the invention is useful in providing a continuous transition of the displacement rate in the vicinity of the upper and lower ends of the lower protion of the displacing head.

The further improvement makes it possible to simply form the lower portion of the displacing head by welding together individual bent plates of comparatively simple geometry.

The improvement of the invention defined in a further embodiment is advantageous in view of achieving particularly small frictional forces between the displacing head and the soil. Thus a long lifetime of the displacing head is obtained.

The improvement of the invention defined in a further embodiment is advantageous in view of simple production of the lower portion of the displacing head and in addition in view of balancing the loads of the displacing rollers, since the latter project beyond the frustoconical basic surface of the lower portion of the displacing head by an equal amount, respectively.

The further improvement of the invention in a further embodiment is advantageous in that no chunks of soil can get jammed between the radial inward portion of the displacing rollers and the frustoconical wall of the lower portion of the displacing head.

The further improvement of the invention in a further embodiment is advantageous in view of simple servicing and simple replacement of the displacing rollers and the bearing units associated thereto.

The further improvements of the invention in a further embodiment warrant, that in cases, where withdrawal of the displacing type drilling tool implies additional displacing work, the frictional forces between the soil and the then effective upper portion of the displacing head are kept small.

Preferred embodiments of the invention will now be described in more detail referring to the drawings. Therein

THE DRAWINGS

SPECIFIC EMBODIMENTS OF THE INVENTION

Figure 1:
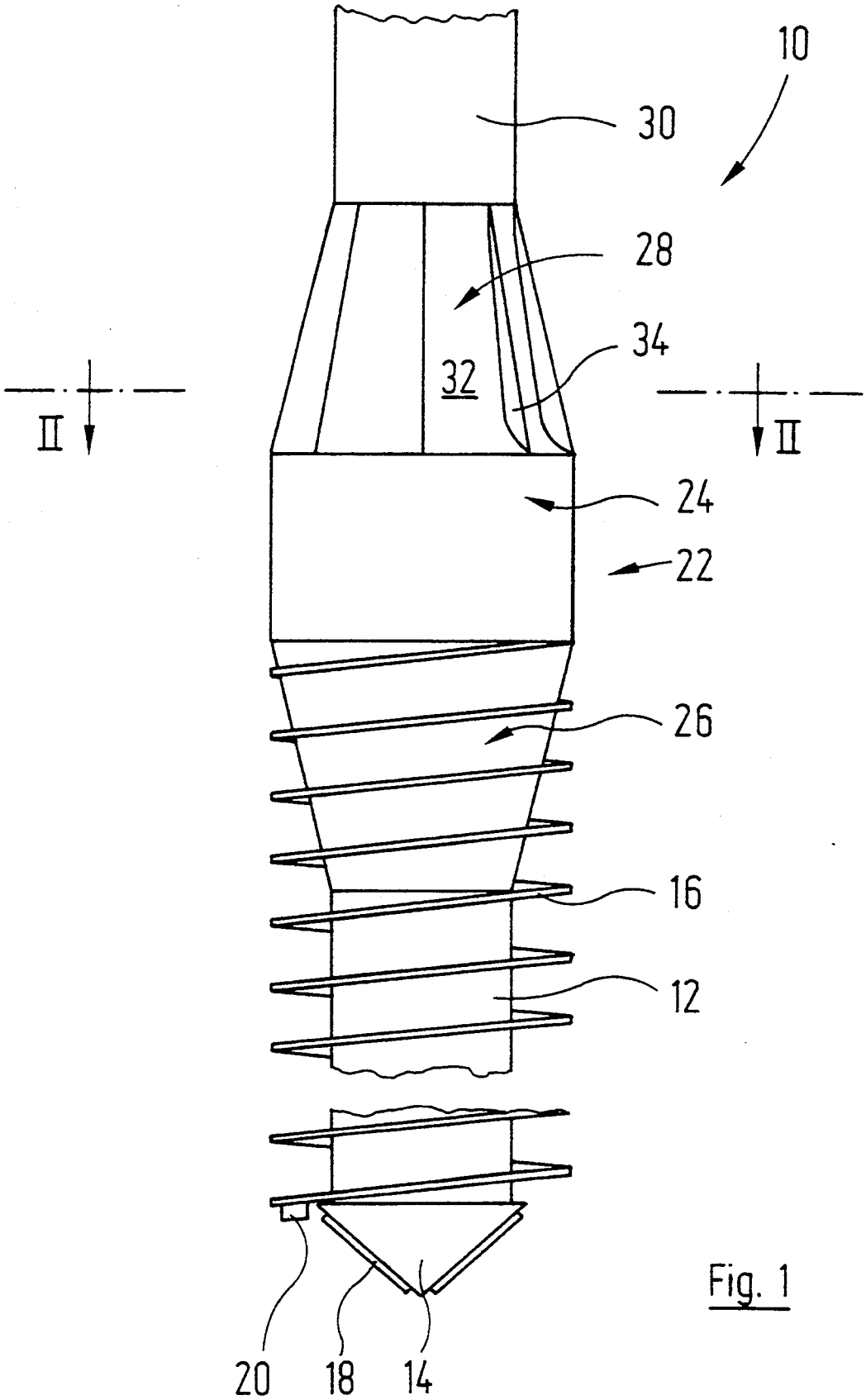
FIG. 1 is a side elevational view of a displacement type drilling tool.

In FIG. 1 a drilling tool of the displacing type is generally shown at 10.

A cylindrical lower drill portion 12 carries a lost drill bit 14. A helical rib 16 is carried by the circumferential surface of the lower drill portion 12. Scraping elements 18 provided on the drill bit 14 and scraping elements 20 provided at the lower end of the helical rib 16 facilitate axial feeding of the drilling tool 10 into the soil.

Above the lower drill portion 12 a displacing head is shown general at 22. The displacing head 22 comprises a smooth cylindrical mid head portion 24, a downwardly converging, frustoconical lower head portion 26 providing a transition to the lower drill portion 12 as well as upwardly converging frustoconical upper head portion 28 providing a transition to an upper drill portion 30, only part of which is shown in the drawings. The upper drill portion 30 is connectable to a drive unit acting on the drilling tool not shown in the drawings.

The drill portions 12 and 30 are of the same diameter. Furthermore, the diameter of the helical rib 16 corresponds to the diameter of the mid head portion 24 of the displacing head 22.

As may be seen from FIG. 1, the helical rib 16 extends over the entire axial extension of the lower head portion 26 of the displacing head 22, the depth of the groove defined by the turns of the helical rib 16 and the surface of the head portion 26 decreasing from the lower end of the head portion 26 to the upper end thereof in continuous manner.

Figure 2:
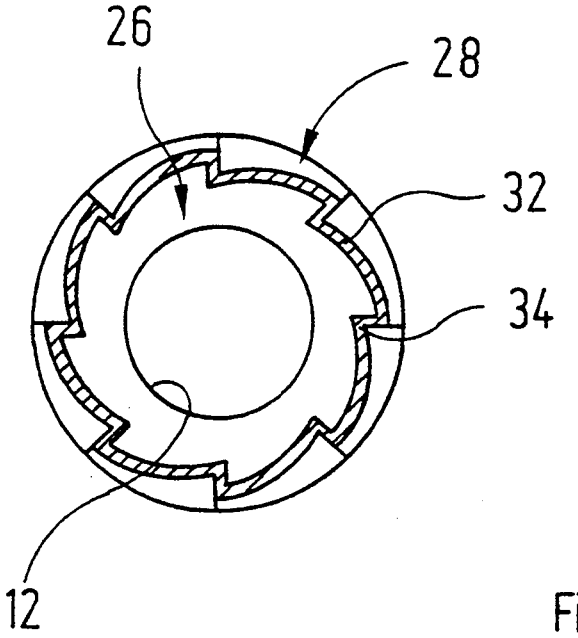
FIG. 2 is a transverse section through an upper portion of the displacing head of the drilling tool in accordance with FIG. 1, the section being along line II—II of FIG. 1.
Figure 5:
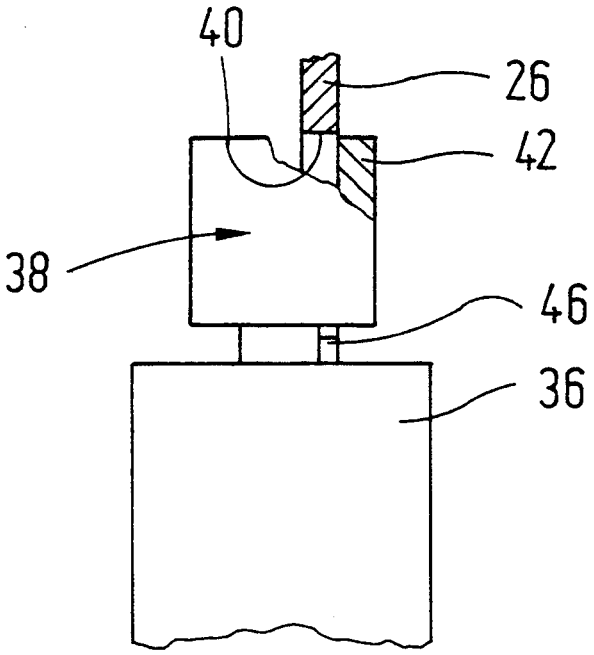
FIG. 5 is an axial section through a bearing unit associated to a displacing roller forming part of the lower portion of the displacing head of the drilling tool shown in FIG. 4, drawn in enlarged scale.
Figure 3:
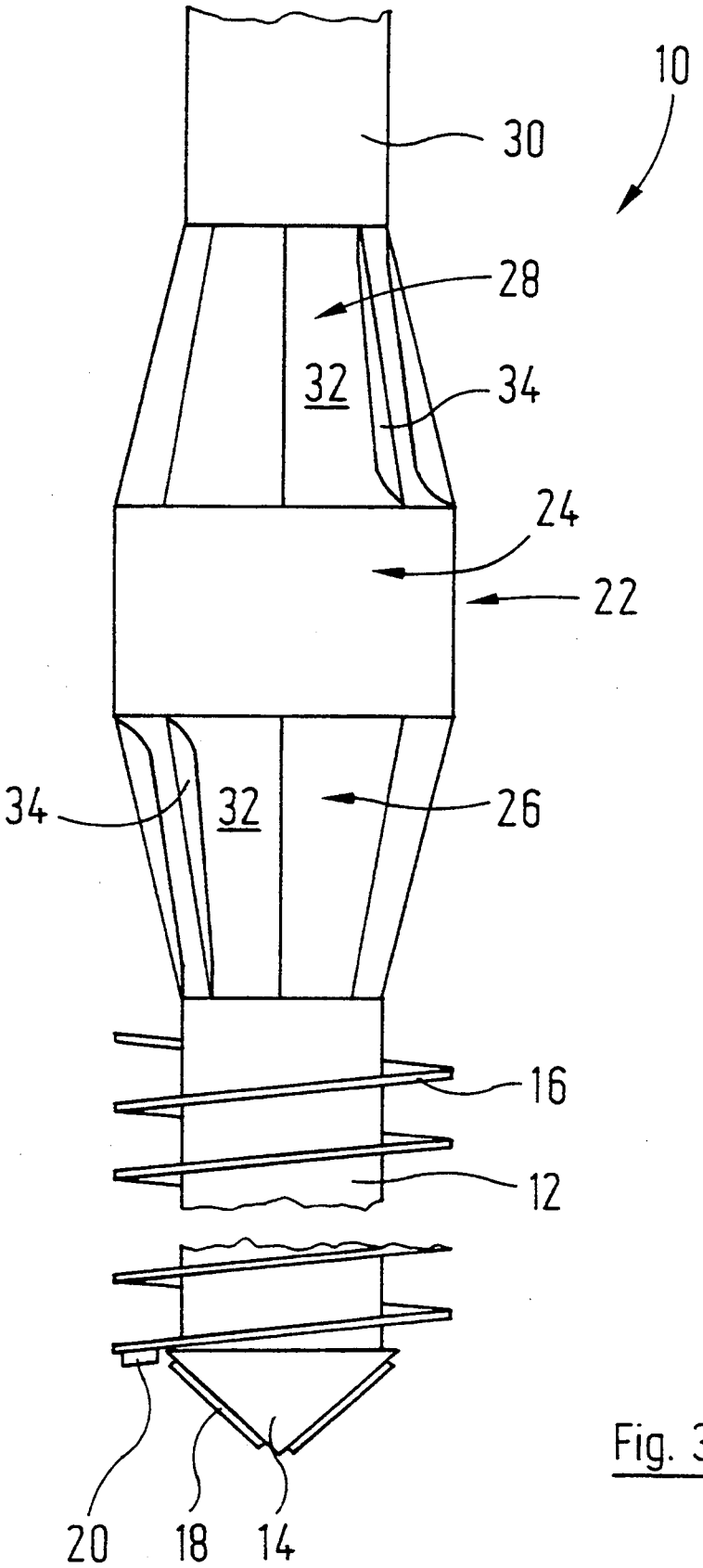
FIG. 3 is a side elevational view of a modified displacement type drilling tool.

As may be seen from FIGS. 2 and 3, the upper head portion 28 is provided with a plurality of spiro-conical displacing walls 32. "Spiro-conical" means that the transverse cross section of the displacing walls 32 corresponds to part of a spiral, while the axial cross section of the displacing walls 32 corresponds to an axial partial section through a cone.

The displacing walls 32 are arranged in such a manner that a radial displacing effect is obtained, when the drilling tool 10 is withdrawn from the hole produced. For such withdrawal the drilling tool 10 is rotated in a direction being opposite to the direction of rotation used for producing the hole, since the drilling tool is provided with the helical rib 16. In FIG. 2 the direction of rotation used for withdrawal of the drilling tool is the c tation used for withdrawal of the drilling tool is the counter clockwise direction.

As may also be seen from FIG. 2, two succesive displacing walls 32 are connected by a shoulder forming wall 34 lying in an axial plane, respectively. Furthermore, the rear ("rear" with respect to the direction of rotation) end of a displacing wall 32 extends in essentially tangential direction of the displacing head, i.e. is perpendicular to the adjacent shoulder forming wall 34.

The displacing walls 32 are bent from plates of appropriate geometry and are connected to the walls 34, which are formed by cut plates of also simple geometry, by welding.

The upper and lower surfaces of the helical rib 16 are provided with wear resisting coatings, which are produced by resurfacing welding and are polished thereafter. A similar wear resistant coating is provided on the outer surface of the frustoconical wall of the head portion 26. Thus soil can move through the groove defined by the helicals rib 16 for extended periods of use under low friction.

In the modified embodiment shown in FIG. 3, the lower head portion 26 of the displacing head 22 is formed analogously to the upper head portion 28 shown in FIG. 1, the displacing walls 32 now being bent and inclined corresponding to the sense of rotation used for withdrawal, which is opposite to the one used for feeding the drilling tool 10 into the soil. The helical rib 16 extends on the lower drill portion 12, only.

A further modified drilling tool not shown in the drawings is obtained by providing on the modified lower head portion 26 shown in FIG. 3 a helical rib 16 corresponding to the one shown in FIG. 1.

Figure 4:
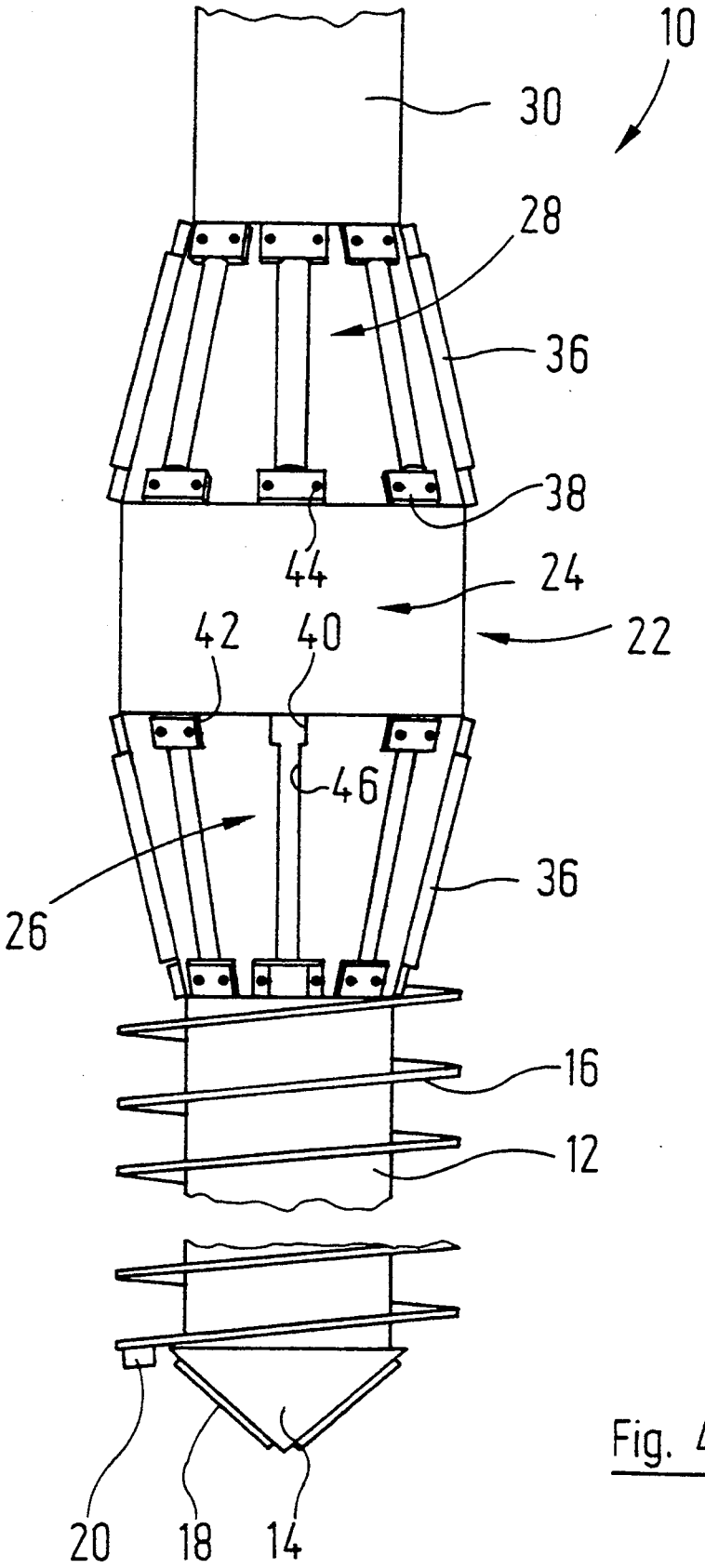
FIG. 4 is a side elevational view of a further embodiment of the displacing type drilling tool.

In a drilling tool 10 in accordance with FIG. 4 the helical rib 16 is provided on the lower drill portion 12, only. In the lower head portion 26 there are provided eight displacing rollers 36 arranged under equal angular distance. The axes of the displacing rollers 36 lie in axial planes of the drilling tool. For journalling the displacing rollers 36 bearing units 38 are provided at either end of the displacing rollers. Windows 40 are provided in the lower head portion 26, which will allow the major portion of the bearing units 38 to be received within the head portion 26. Only thin mounting members 42 of the bearing units 38 rest on the exterior surface of the lower head portion 26 being removably connected thereto by means of screws 44.

The displacement rollers 36 engage in further windows 46 provided in the frustoconical wall of the lower head portion 26.

As may be seen from FIG. 4, the upper head portion 28 of the displacing head 22 is formed the same way as the lower head portions 26 thus also carrying a plurality of circumferentially spaced displacing rollers 36.

Modifying the embodiment of FIG. 4, the upper head portion 28 may also be formed the way shown in FIG. 3, since in many cases withdrawal of a displacing type drilling tool from a hole produced will require only a small amount of displacing work to be effected by the displacing head 22 such that the simpler upper head portion 28 in accordance with FIGS. 1 and 2 will be sufficient.

We claim:

1. A drilling tool of the displacing type, comprising a) a lower drill portion (12) having a cylindrical core and a helical rib (16) carried thereby, a drill bit (14) being carried by the lower drill portion (12), b) a displacing head (22) connected no the lower drill portion (12) and in turn including a mid head portion (24) of axially constant cross section, the radial dimension of which is larger than the radial dimension of the lower drill portion (12) and a lower downwardly converging head portion (26), and c) an upper drill portion (30) connected to the displacing head (22) and being connectable to a drive unit, wherein the lower head portion (26) is of essentially frustoconical geometry and the surface thereof carries a plurality of angularly spaced displacing ribs (32, 34), an outer working surface of which is of spiroconical geometry.

2. A drilling tool as in claim 1, wherein a shoulder (34) defined between the rear end of a displacing rib (32, 34) and the forward end of the angularly succeeding displacing rib (32, 34) has a radial extension or height decreasing towards the axial ends of the lower head portion (26).

3. A drilling tool as in claim 1, wherein the shoulders (34) defined between the rear end of a displacing rib (32, 34) and the forward end of an angularly succeeding displacing rib, respectively, lie in axial planes of the drilling tool.

4. The drilling tool as in claim 1, wherein an upper head portion (28) is of essentially frustoconical shape and in that its surface is formed with angularly spaced displacing ribs (32, 34) each having a spiroconical working surface, the sense of bending of the displacing ribs (32, 34) of the upper head portion (28) being opposite to the bending sense of the displacing ribs (32, 34) of the lower head portion (26).

* * * * *

UNITED STATES PATENT AND TRADEMARK OFFICE

CERTIFICATE OF CORRECTION

PATENT NO. : 5,353,883

DATED : October 11, 1994

INVENTOR(S) : Hinrich KATTENTIDT et al.

It is certified that error appears in the above-indentified patent and that said Letters Patent is hereby corrected as shown below:

Column 4, line 26, change "no" to --to--.

Signed and Sealed this

Seventh Day of March, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,353,883

DATED : October 11, 1994

INVENTOR(S) : Hinrich KATTENTIDT et al.

It is certified that error appears in the above-indentified patent and that said Letters Patent is hereby corrected as shown below:

On cover page delete item "[73]" and insert:

--[73] Assignee: DELMAG Maschinenfabrik Reinhold Dornfeld GmbH & Co., Esslingen, Fed. Rep. of Germany--

Signed and Sealed this

Fifth Day of September, 1995

*Attest:*

*Attesting Officer*

BRUCE LEHMAN

*Commissioner of Patents and Trademarks*